United States Patent [19]

Crozet

[11] 3,980,982

[45] Sept. 14, 1976

[54] METHOD OF ASSEMBLY OF THE SUPPORT FOR THE MAGNETIC CORE OF A SHELL-TYPE, FORM-FIT TRANSFORMER

[75] Inventor: Roger Crozet, Tassin la Demi Lune, France

[73] Assignee: Jeumont-Schneider, Puteaux, France

[22] Filed: Mar. 31, 1975

[21] Appl. No.: 563,828

[30] Foreign Application Priority Data

Mar. 29, 1974 France ..... 74.11089

[52] U.S. Cl. ..... 336/92; 29/606; 336/197

[51] Int. Cl.[2] ..... H01F 27/06

[58] Field of Search ..... 336/84, 90, 92, 197; 29/606, 602

[56] References Cited

UNITED STATES PATENTS

| | | | |
|---|---|---|---|
| 2,085,080 | 6/1937 | Brown | 336/92 |
| 3,082,391 | 3/1963 | Chiki | 336/92 X |
| 3,538,472 | 11/1970 | Bell et al. | 336/84 |
| 3,571,772 | 3/1971 | Bennon et a. | 336/92 |
| 3,821,677 | 6/1974 | Boaz | 336/84 |

*Primary Examiner*—Thomas J. Kozma
*Attorney, Agent, or Firm*—Bacon & Thomas

[57] ABSTRACT

A method and apparatus applicable with transformers having a magnetic circuit which is supported horizontally within a tank or shell made up of upper and lower parts, wherein a two-piece bar-like member assembly supported at its extremities on edges of the lower part of the tank, along with a conventional T-shaped beam support member is utilized to support the core laminations in such a manner that wedges used to fix in place the windings of the circuit can be readily adjusted beneath the area of the T-shaped beam. The bars are tensioned in place by adjustment of the wedges between the lower area of the windings and the tank sidewalls. The beam is then placed on the edges and anchored thereon.

5 Claims, 3 Drawing Figures

METHOD OF ASSEMBLY OF THE SUPPORT FOR THE MAGNETIC CORE OF A SHELL-TYPE, FORM-FIT TRANSFORMER

BACKGROUND

The present invention relates to a method of assembling of the support for the magnetic core of a transformer of the shell form-fit type, after the operation of putting the windings in place in the lower part or tank base. It is known that, in the case of large power transformers of this type, the magnetic circuit is disposed horizontally and the tank is made in two parts, with the lower base part being provided with a flange serving as an end frame for the yokes of the magnetic circuit, and the upper form-fit tank part used for clamping their yokes. The magnetic core is supported by a T-shaped beam facilitating support at its extremities on the flanges of the base.

The problems of resistance to the electromagnetic stresses due to short circuits, particularly severe in the case of large units, requires a very effective bracing or wedging on the active part of the transformer in its tank. In the present method of assembly, the use of only a single, unitary T-shaped beam prevents an easy way of carrying out adjustment of the bracing of the windings in the base near the extremities of the magnetic cores because the beam covers this area.

SUMMARY

The method according to the present invention overcomes these disadvantages. It is accomplished by the sequence of operations as follows:

Putting in place in the two lower corners of the center opening of the windings, two parallel bars of non-magnetic steel, the extremities of which are hung or anchored on the edge of the base;

Inserting insulated spacers into the lower extremities of the windings between the said lower extremities and the lateral sides of the base, so as to tension the two bars;

Putting in place between the two bars a metallic T-shaped beam, the extremities of which are provided with means for hanging on the edge of the base;

Tensioning this beam by adjustment of the hanging means is possible before the stacking of magnetic iron sheets of the core on the beam and the bars.

BRIEF DESCRIPTION OF THE DRAWINGS

The invention will be better understood with the aid of the following description and the attached drawings wherein.

DETAILED DESCRIPTION

Prior Art

Figure 1:
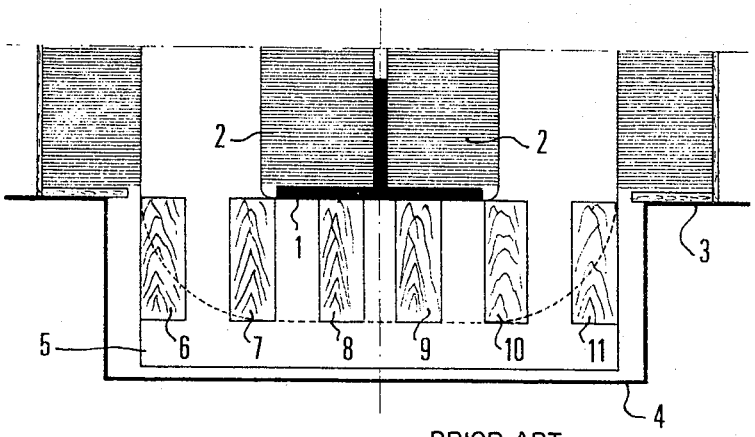
fig.1 PRIOR ART
FIG. 1 is a sectional view of the prior art support illustrating the T-shaped beam.

In the prior art method (FIG. 1) a T-shaped beam 1 serves to support magnetic iron sheets 2 of the core. They rest with their extremities on the edge or flange 3 of a base 4 of the tank or they are supported through appropriate means.

This beam 1 is not put in place until after insertion into the base of the block of insulated windings 5, and after having placed between the lower extremity of this block and the part adjacent to the base, the insulated wedges 6–11.

The T-shaped beam 1 is next tensioned between the edges or flanges of the base by adjustment of its anchoring means. Accurate positioning and fixing in place of the block of insulated windings 5 requires that one can easily adjustably position the wedges 6 through 11. That is usually possible for the wedges 6, 7, 10, 11, but not for the wedges 8 and 9 situated beneath the T-shaped beam. As a result, the bracing may become uneven or unequal in these areas.

Invention

Figure 2:
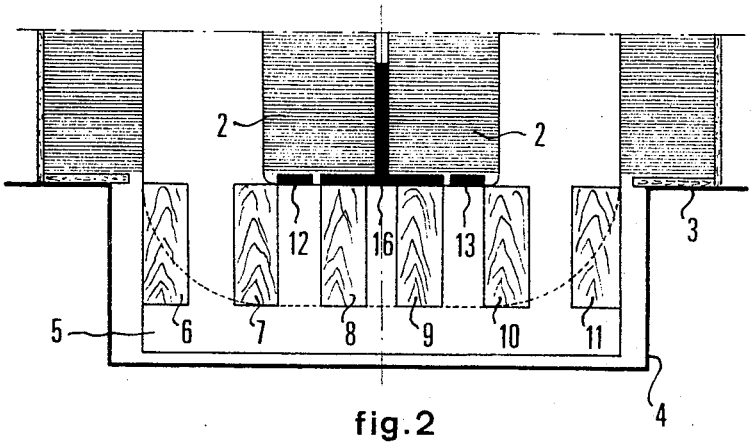
FIGS. 2 and 3 represent, respectively, a sectional view and a side view of a support for the electromagnetic winding utilizing the present invention, taken along lines II—II and III—III, respectively, of FIGS. 3 and 2.
Figure 3:
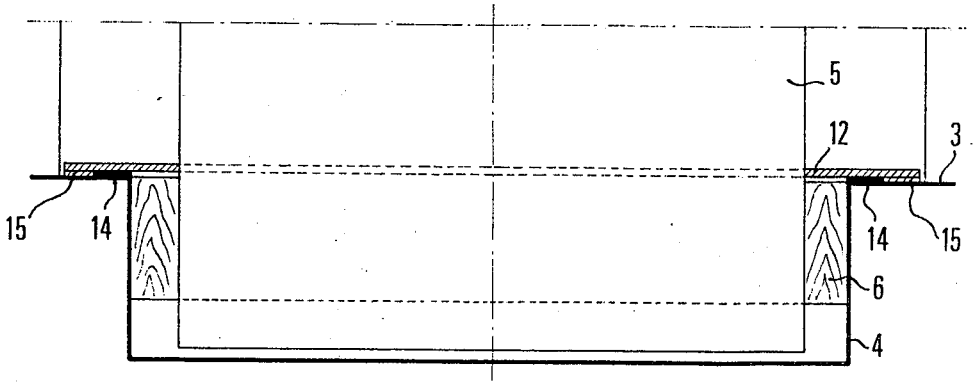

This major inconvenience does not exist when the present invention is utilized, as illustrated in FIGS. 2 and 3. In accordance with the present invention, after the windings 5 have been placed in the base, two non-magnetic steel bars 12 and 13 are placed at the two lower corner areas of the central opening of the block of windings 5, that is, where the core elements 2 are to be stacked. The ends of these bars, as can be seen in FIG. 3, are supported on the edge of the base by means of two shoulders 14 and 15, the one 14 being soldered to the base, the other 15 soldered to the bars. The positioning and fixing in place of the block of windings 5 is effected by adjusting the positions of wedges 6 through 11 and the resultant tensioning of the bars 11 and 12. One can see in this case the wedges 8 and 9 are readily accessible between bars 12 and 13 and are therefore able to be easily adjusted.

After the desired fixing in place of winding 5 is obtained, a T-shaped beam 16 having a lower leg narrower than the T-shaped beam shown in FIG. 1 is inserted between the bars 12 and 13.

The metal beam 16 is put in tension by the adjustment of its hanging means in the same way as the beam 1. The bracing of the windings by means of the beam 16 with the bars 12, 13 completes the bracing system. The stacking of the iron sheets of the magnetic core on the beam 16 and the bars 12, 13 is then carried out.

The invention is applied with large transformers or reactors of the form-fit shell-type.

While one embodiment of the invention has been described, it will be understood that it is capable of many further modifications and this application is intended to cover any variations, uses, or adaptations of the invention following in general, the principles of the invention and including such departures from the present disclosure as come within knowledge or customary practice in the art to which the invention pertains, and as may be applied to the essential features hereinbefore set forth and fall within the scope of the invention or the limits of the appended claims.

I claim:

1. A method of assembling a transformer having a housing base, windings and a magnetic sheet core comprising:

a. placing the windings in the housing base having sides and edges thereon, b. placing a plurality of substantially parallel bars on a pair of opposite edges of the base, c. inserting insulated wedges into the lower extremities of the windings between said lower extremities and the lateral sides of the base and tensioning said bars, d. placing a substantially T-shaped beam between said bars and anchoring the extremities of said beam on the edges of said base, and e. stacking a plurality of iron sheets on said beam, bar and edges.

2. The method of claim 1 including securing said bars to the edges of the base.

3. The method of claim 2 wherein said wedges force the sides outwardly to cause the tensioning.

4. The method of claim 1 including adjusting a plurality of said wedges after positioning said bars and prior to placement of said beam.

5. A transformer comprising:

a. a housing base having at least a pair of edges, b. a winding in said base, c. a plurality of parallel bars secured to a pair of opposite edges of said base, d. a generally T-shaped beam positioned on said base between said bars, e. a plurality of wedge means in said base below said bars and beam for tensioning said bars, f. a plurality of iron sheets being stacked on said beam, bar and edges.

* * * * *